US011377761B2

(12) United States Patent
D'Agnolo et al.

(10) Patent No.: US 11,377,761 B2
(45) Date of Patent: Jul. 5, 2022

(54) SPINNING APPARATUS, AIR SPINNING APPARATUS IN PARTICULAR, WITH CONTINUOUS ADJUSTMENT OF A YARN ACCUMULATION SYSTEM AND RELATED METHOD OF CONTINUOUS ADJUSTMENT OF A YARN ACCUMULATION SYSTEM IN A SPINNING APPARATUS

(71) Applicant: SAVIO MACCHINE TESSILI S.p.A., Pordenone (IT)

(72) Inventors: Fabio D'Agnolo, Pordenone (IT); Marco Gobbesso, Pordenone (IT)

(73) Assignee: SAVIO MACCHINE TESSILI S.p.A., Pordenone (IT)

( * ) Notice: Subject to any disclaimer, the term of this patent is extended or adjusted under 35 U.S.C. 154(b) by 0 days.

(21) Appl. No.: 16/750,619

(22) Filed: Jan. 23, 2020

(65) Prior Publication Data

US 2020/0240048 A1 Jul. 30, 2020

(30) Foreign Application Priority Data

Jan. 28, 2019 (IT) ..... 102019000001195

(51) Int. Cl.
*D01H 1/34* (2006.01)
*D01H 13/04* (2006.01)

(52) U.S. Cl.
CPC ..... *D01H 1/34* (2013.01); *D01H 13/04* (2013.01)

(58) Field of Classification Search
CPC ... D01H 1/34; D01H 1/38; D01H 4/48; B65H 51/20; B65H 51/22
See application file for complete search history.

(56) References Cited

U.S. PATENT DOCUMENTS 3,669,373 A * 6/1972 Hori ..... D01H 1/38 242/475.7
4,442,573 A * 4/1984 Hirschburger ..... B65H 51/22 242/364.6
2013/0327877 A1* 12/2013 Zenoni ..... D04B 15/484 242/419.1

FOREIGN PATENT DOCUMENTS

EP 1457447 A2 * 9/2004 ..... B65H 59/18
EP 1460015 A1 9/2004
(Continued)

OTHER PUBLICATIONS

Lexico, continuous, via https://www.lexico.com/en/definition/continuous (last visited Nov. 22, 2021) (Year: 2021).*
(Continued)

*Primary Examiner* — Shaun R Hurley
*Assistant Examiner* — Patrick J. Lynch
(74) *Attorney, Agent, or Firm* — Armstrong Teasdale LLP

(57) ABSTRACT

A spinning apparatus with continuous adjustment of a yarn accumulation system includes at least one spinning head including a spinning device including a spinning chamber for yarn production, a reel on which yarn produced by the spinning device is wound, the reel being rotatably influenced by a yarn guide shaped to impart a rotation movement of the reel for winding the yarn and a traversing movement of the yarn winding on the reel, an accumulation device arranged between the spinning device and the reel and shaped to create a reservoir of yarn not wound on the reel, a joining device including joining means to join together a first yarn end associated with the spinning device and a second yarn end associated with the reel, and a processing and control unit programmed to control the yarn guide to adjust accordingly the amount of yarn accumulated in the accumulation device.

20 Claims, 7 Drawing Sheets

(56) References Cited

FOREIGN PATENT DOCUMENTS

| | | | | |
|---|---|---|---|---|
| EP | 2573217 | A2 * | 3/2013 | ..... B65H 51/22 |
| EP | 3009387 | A1 | 4/2016 | |
| EP | 3498641 | A1 * | 6/2019 | ..... B65H 51/22 |
| JP | 2016102268 | A * | 6/2016 | ..... D01H 13/04 |

OTHER PUBLICATIONS

Italian Search Report for Italian Patent Application No. 102019000001195, dated Sep. 26, 2019. 2 pages. No English translation available.

* cited by examiner

SPINNING APPARATUS, AIR SPINNING APPARATUS IN PARTICULAR, WITH CONTINUOUS ADJUSTMENT OF A YARN ACCUMULATION SYSTEM AND RELATED METHOD OF CONTINUOUS ADJUSTMENT OF A YARN ACCUMULATION SYSTEM IN A SPINNING APPARATUS

CROSS-REFERENCE TO RELATED APPLICATIONS

This application claims the benefit of priority to Italian Patent Application No. 102019000001195, filed Jan. 28, 2019, the entire contents of which are hereby incorporated by reference herein.

FIELD OF APPLICATION

The present invention relates to a spinning apparatus, an air spinning apparatus in particular, with continuous adjustment of a yarn accumulation system and related method of continuous adjustment of a yarn accumulation system in a spinning apparatus.

BACKGROUND

As known, in spinning systems with no accumulation, the possibility of making conical reels (3° 30', 4° 20', 5° 57') is not ensured because there is no possibility of balancing the difference in speed between tail and head of the reel, nor may it be joined with traditional-type systems (for example of the splicer-type) because there is no possibility of "stopping" the spinning for the joining cycle: therefore, there is an obligation to use more complicated reattachment systems which have the great defect of making joins of lesser quality.

Known accumulation spinning systems instead also allow conical reels to be made, but at the same time have the problem of stressing the yarn with continuous attaching/detaching cycles of the reel to/from the related pulling cylinder. The system is intrinsically adapted to eliminate the repps because the continuous attachment/detachment randomly varies the speed of the reel (for example, systems of this type which are activated at the critical diameter ratios, are used in winding). The frequency of the attachment/detachment cycles however cannot be accurately set nor can it be adjusted in a uniform manner on all the heads of the spinning apparatus because the tension adjustment function is typically handled by a highly sensitive magnetic-type friction system which requires a fine adjustment to work well.

The known spinning systems which use this type of attachment/detachment cycle moreover do not allow well-made reels to be made because the warp tension suddenly changes in the presence of the cycle, causing layers with different tension to be deposited and thus increasing the possibility of having dropped coils at the edges and therefore the lack of homogeneity of the corresponding reel.

SUMMARY

The need is therefore felt to solve the drawbacks and limitations mentioned in reference to the prior art.

Such a need is satisfied by a spinning apparatus with continuous adjustment of a yarn accumulation system disclosed herein, and by a related method of continuous adjustment of a yarn accumulation system in a spinning apparatus disclosed herein.

DESCRIPTION OF THE DRAWINGS

Further features and advantages of the present invention will become more comprehensible from the following description of preferred and non-limiting embodiments thereof, in which.

The elements or parts of elements common to the embodiments described below will be indicated using the same numerals.

DETAILED DESCRIPTION

Figure 1:
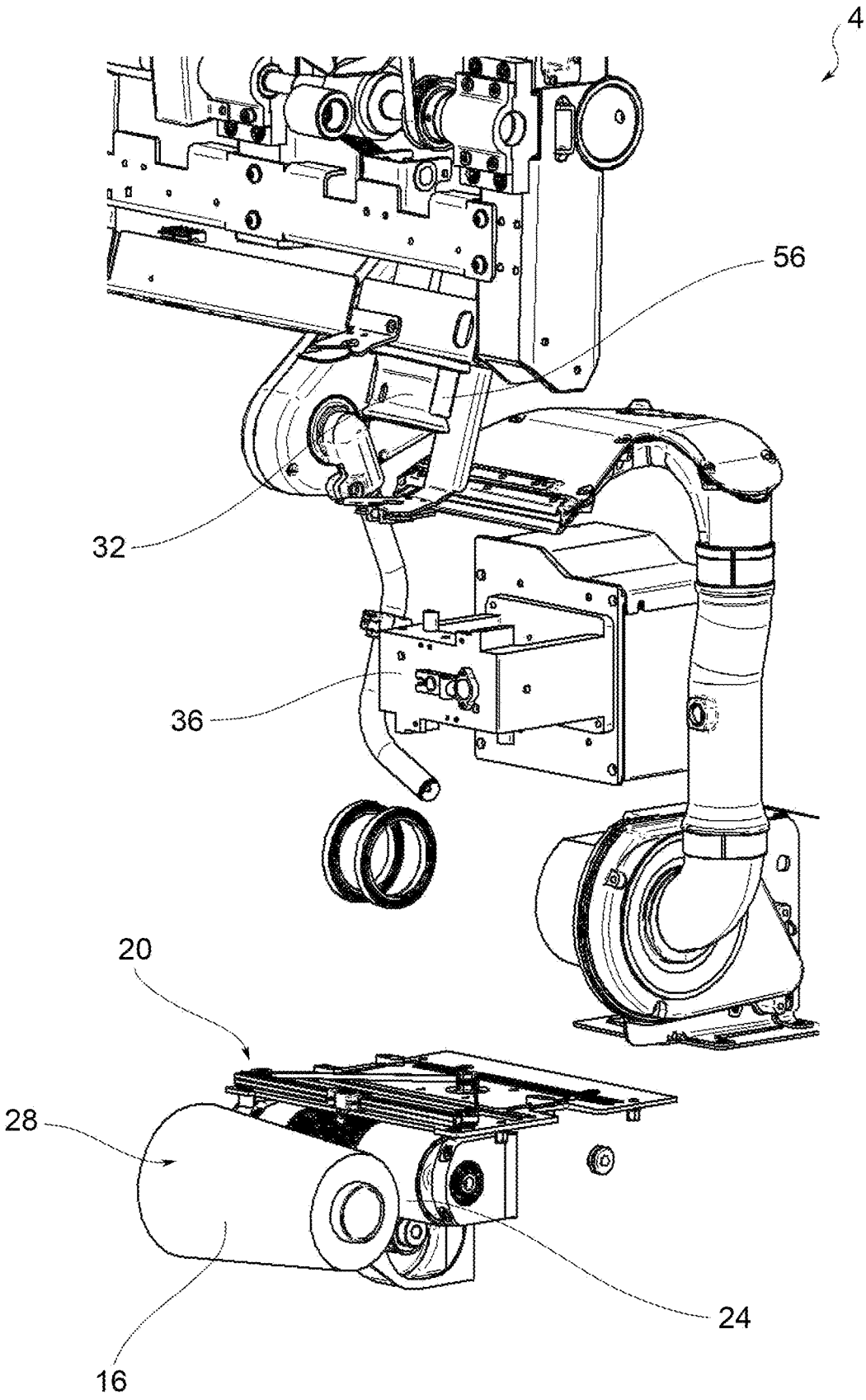
FIG. 1 shows a perspective view, with partially separate parts, of a spinning apparatus with continuous adjustment of a yarn accumulation system, according to one embodiment of the present invention.
Figure 2:
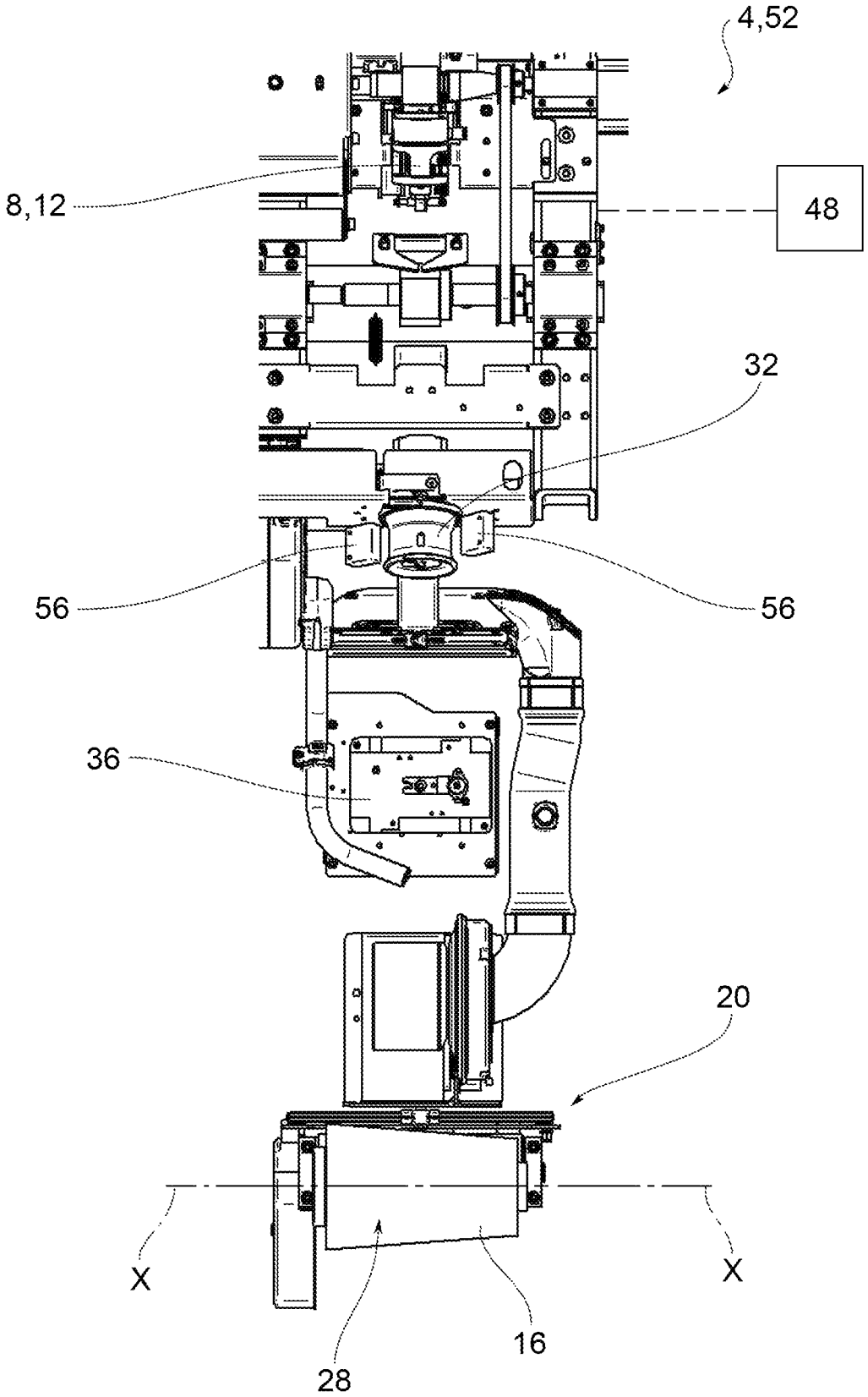
FIGS. 2 to 3 show front views, in assembled configuration, of a spinning apparatus with continuous adjustment of a yarn accumulation system in FIG. 1.
Figure 3:
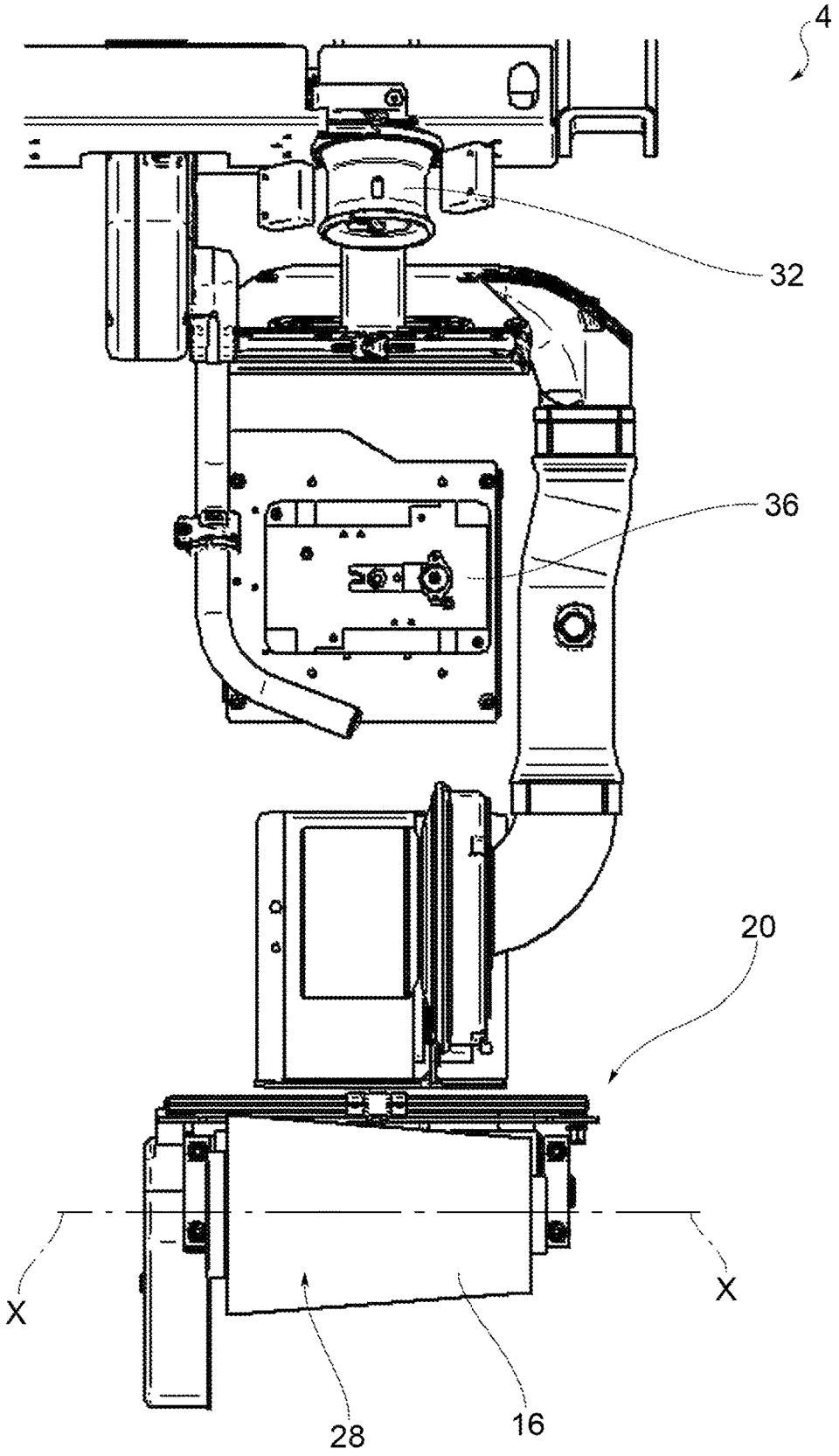
Figure 5:
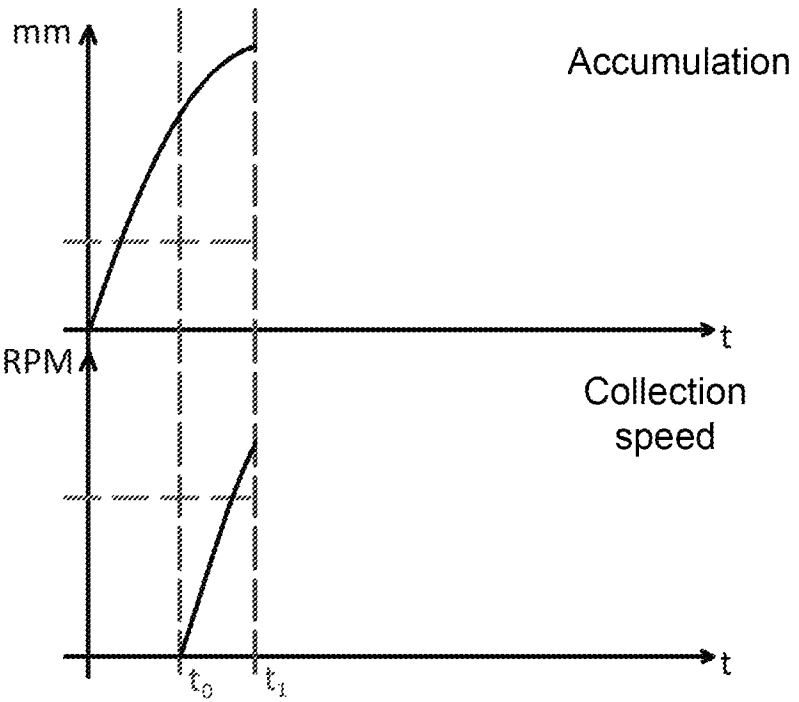
FIGS. 4 to 10 show graphs of the trend of the yarn accumulation and of the collection or rotation speed of the reel according to possible adjustment methods according to the present invention.
Figure 4:
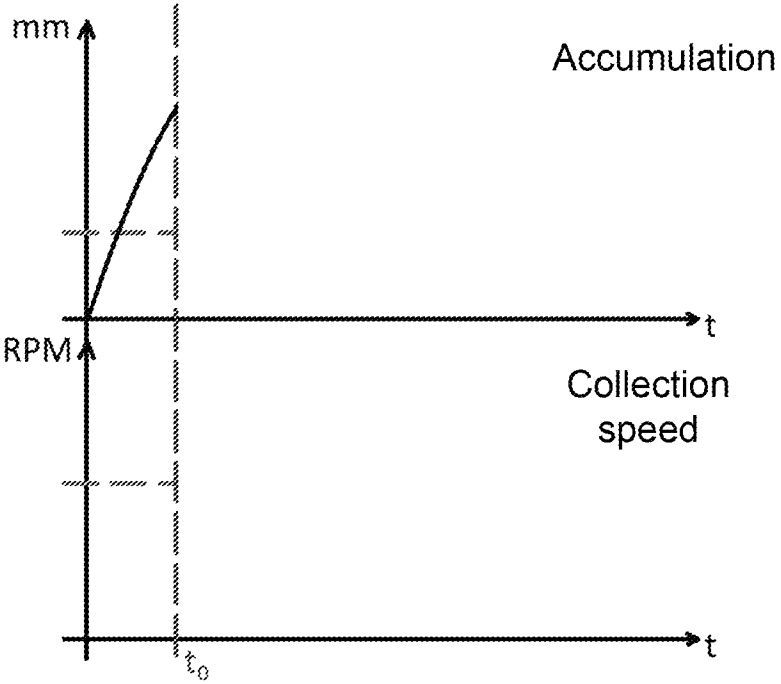
Figure 7:
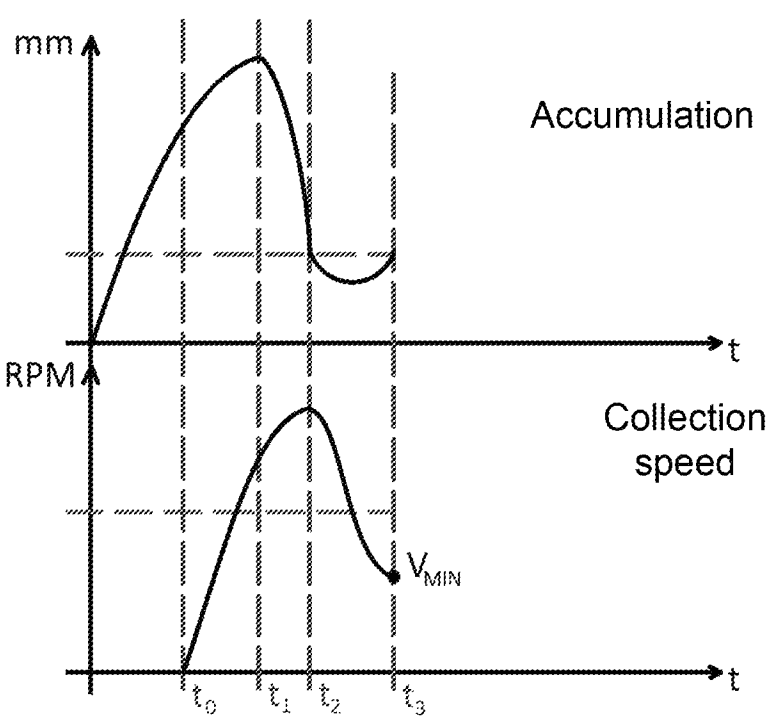
Figure 6:
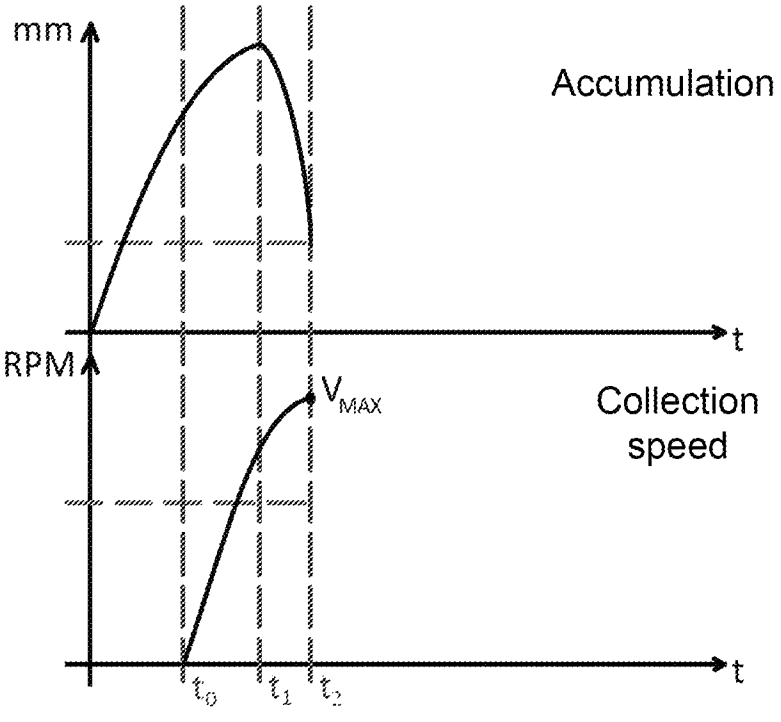
Figure 9:
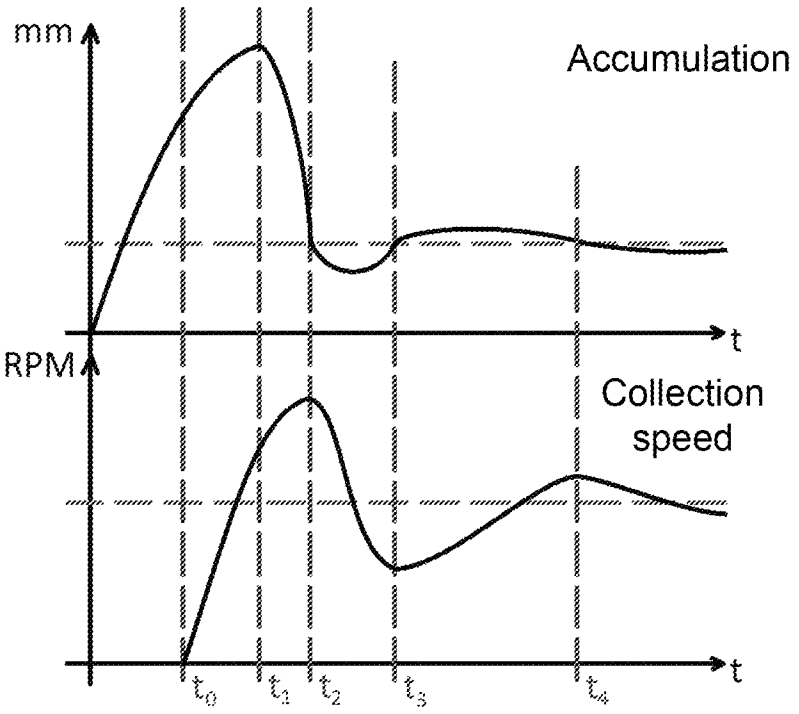
Figure 8:
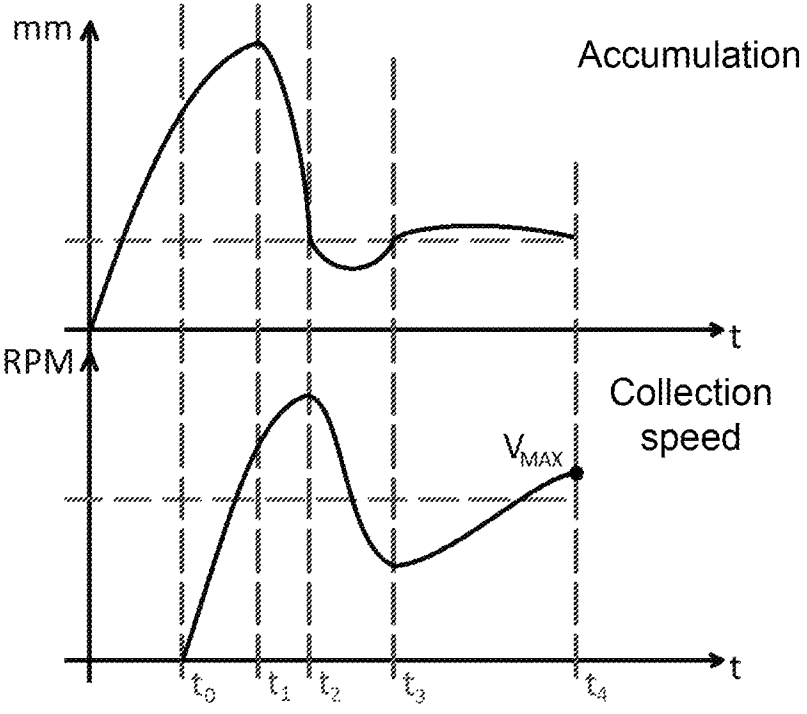

With reference to the aforesaid drawings, a spinning apparatus with continuous adjustment of a yarn accumulation system, which is better described later, is indicated as a whole with 4.

It is worth noting that the present invention preferably, but not exclusively, applies to a spinning apparatus of the air type, i.e. an air-jet spinning apparatus. Such an invention may also be applied to a spinning apparatus having a mechanical spinning rotor, for example.

In any case, for the purposes of the present invention, the spinning apparatus 4 may be of any type, shape and size.

Said spinning apparatus 4 comprises a spinning device 8 comprising a spinning chamber 12 for yarn production. For example, the spinning chamber 12 may comprise a plurality of air jets (not shown) oriented in direction which substantially is tangential to corresponding ribbons arranged in input in the spinning chamber 12 itself so as to weave said ribbons with one another and obtain a single yarn F in output from the air spinning chamber 12.

The spinning apparatus 4 further comprises a reel 16 on which said yarn produced by the spinning device 8 is wound.

Reel 16 is rotatably influenced by a yarn guide 20 shaped to impart a rotation movement of reel 16 for winding the yarn and a traversing movement of the yarn winding on reel 16 itself. Reel 16 rotates about a substantially horizontal rotation axis X-X. Reel 16 may have both cylindrical shape and conical shape with respect to said rotation axis X-X.

The rotation of reel 16 may typically occur by means of a winding cylinder 24 (also called pulling cylinder) in direct contact with an outer side surface 28 of reel 16 so as to pull the latter in rotation by friction, in known manner. Different devices suitable to allow the rotation of reel 16 about its rotation axis X-X may also be employed to obtain the winding of the yarn.

The spinning apparatus 4 further comprises an accumulation device 32 of the yarn produced, arranged between the spinning device 8 and reel 16, shaped to create a reservoir of yarn not wound on reel 16.

In other words, the accumulation device 32 constitutes a kind of reservoir of yarn which is wound thereon before being wound on the reel. During the reattachment step of the yarn, the yarn which continues being produced by the spinning device 8 is wound about the accumulation device 32, which typically is shaped as a cylindrical body, preferably a concave cylindrical body.

As mentioned above, the spinning apparatus 4 further comprises a joining device 36 comprising joining means suitable to join together a first yarn end associated with the spinning device 8 and a second yarn end associated with reel 16. In other words, the first yarn end is connected to a section of yarn coming out of the spinning device 8 or arranged on the side of the spinning device 8, while the second yarn end is connected to a section of yarn connected to reel 16 or arranged on the side of reel 16.

Advantageously, the spinning apparatus 4 further comprises a processing and control unit 48 programmed to control the yarn guide 20 according to the spinning pattern so as to adjust accordingly the amount of yarn accumulated in the accumulation device 32.

The spinning apparatus typically comprises a plurality of spinning heads 52—each spinning head 52 being provided with its own yarn guide 20 which influences a corresponding reel 16—of its own accumulation device 32 of the yarn produced.

The apparatus further comprises at least one yarn presence sensor 56 which detects the presence or absence of yarn wound on the accumulator or accumulation device 32: thereby the presence of yarn detects the proper operation of the apparatus, while the absence of yarn detects the need to restore the accumulation of yarn on the apparatus without ever reaching the condition of lack of accumulated yarn.

According to a further embodiment, there are provided at least two yarn detection sensors 56 arranged at suitable distance from each other: the processing and control unit may be controlled so as to vary the rotation speed of reel 16 so as to always keep the amount of yarn within the limits of said two sensors 56: thereby the amount of yarn accumulated is made as constant as possible.

The yarn presence sensor 56 may be of various types comprising both capacitive-type sensors and resistive-type sensors.

Said processing and control unit 48 is programmed to manage each spinning head 52 and the respective devices independently from each other.

According to a possible embodiment, the processing and control unit 48 in particular is programmed to continuously adjust the rotation speed of reel 16 so as to make substantially constant the amount of yarn accumulated in the accumulation device 32.

According to an embodiment, the processing and control unit 48 is programmed so that when the spinning cycle begins, it begins to spin with a yarn extraction speed, in output from the spinning device 8, varying between a minimum and a maximum value. For example, when the spinning cycle begins, it starts to spin with a yarn extraction speed varying between the minimum value of 200 [m/min] and the maximum value of 500 [m/min].

Said yarn is fed to the joining device 36 where it is joined to the yarn coming from reel 16; the yarn coming out of the spinning chamber 12, during the time of the reattachment cycle, is deposited in the accumulation device 32.

Moreover, the processing and control unit 48 is programmed so that, at the end of the yarn joining by the joining device 36, the yarn collection in reel resumes and the accumulation of yarn in the accumulation device 32 is adjusted by adjusting the rotation speed of the pulling cylinder (or winding cylinder) 24 or collection speed of reel 16.

According to a possible embodiment, the adjustment of the rotation speed of reel 16 occurs so as to:

keep the amount of yarn accumulated around a threshold value so as not to throw away too much in case of breaking or cutting by default, and to always have a sufficient reserve to compensate for the speed variations between tail and head of the reel, make the winding tension as regular as possible, preventing it from falling or increasing beyond a certain percentage value (which can be selected as desired), as a function of the emptying or filling step of the accumulation device 32 itself.

For example, the processing and control unit 48 is programmed so that:

after the initial emptying of the accumulation device 32, following a yarn reattachment step, the processing and control unit 48 determines the optimal value of the reel extraction speed 16, according to the following step (first self-adjustment step):

a) the rotation speed of reel 16 is reduced by a value proportional to the first emptying time of the accumulation device 32.

First emptying time means the time used the first time to empty the accumulation device 32 of the yarn accumulated.

The processing and control unit 48 preferably is programmed so that:

b) at regular intervals, the rotation speed of reel 16 is reduced to further promote yarn accumulation in the accumulation device 32.

Thereby, the amount of yarn accumulated in the accumulation device 32 can be increased, when needed.

According to an embodiment, the processing and control unit 48 is programmed so that:

c) when the yarn presence sensor 56 detects the presence of the yarn, the contingent rotation speed (V1) of the reel is stored in the presence of the yarn.

Thus, the processing and control unit 48 is programmed so that:

d) at regular intervals, the collection speed of the reel 16 is increased to facilitate the unwinding of the yarn by the accumulation device 32.

According to an embodiment, the processing and control unit 48 is programmed so that:

e) when the yarn presence sensor 56 no longer detects the presence of yarn, the processing and control unit 48 stores the contingent rotation speed (V0) of the reel in the absence of yarn.

Thus, the processing and control unit 48 is programmed so that:

f) said processing and control unit 48 calculates the average speed (Vm)=(V1+V0)/2 between the reel 16 pulling speed V1 when sensor 56 detects the presence of the yarn and the reel 16 pulling speed V0 when sensor 56 detects the absence of the yarn.

The resulting average speed value is provided for example, to a proportional-integral regulator (P.I.) conveniently configured to control the rotation of reel 16 at said average speed (Vm). The use of a proportional-integral regulator (P.I.) is only explicative and indicative of one of the methods for controlling reel 16 to rotate at said average speed Vm.

The processing and control unit 48 preferably is programmed so that:

g) at each change of status of the yarn presence sensor 56, the relative rotation speed value (V1 or V0) of the reel is updated, respectively in the presence and absence of yarn.

The variations in the time domain of yarn collection speed by reel 16 and of yarn accumulation on said accumulation device 32 following the continuous adjustments made by the processing and control unit 48 are depicted in FIGS. 4 to 9, as described later.

According to an embodiment, the processing and control unit 48 is programmed so as to:

vary, where necessary, the tension of the yarn accumulating in the accumulation device 32, modifying the linear speed of accumulation by a positive and settable % allowing the accumulation of the coils of yarn on the accumulation device 32 to be compacted and regularising the unwinding thereof in output;

compensate for such a variation by the yarn guide 20 which will change its course to maintain the best conditions for the formation of reel 16.

According to a possible embodiment, the processing and control unit 48 is programmed so as to perform the following steps:

at the instant t=t0 the yarn joining operation is terminated and the accumulation device 32 must be emptied;

a yarn presence sensor 56 is active;

the rotation or collection speed of reel 16 is increased to rapidly empty the accumulation device 32;

at the instant t=t1 the accumulation device 32 has been emptied beyond a target level (reserve);

the yarn presence sensor 56 is no longer active;

the contingent collection or rotation speed VMAX=V1 is stored, and then the collection speed itself of reel 16 is reduced in order to increase said target level of yarn accumulation.

Moreover, if at the instant t=t2 the accumulation device 32 is exceeding the target level (reserve), the yarn presence sensor 56 is active, the contingent collection speed VMIN=V2 of reel 16 is stored and the collection speed is adjusted to an average VAV value between VMIN and VMAX.

According to a possible embodiment, the processing and control unit 48 is programmed so as to perform the following steps:

at each transition of the yarn presence sensor 56 the VMIN or VMAX value is updated, and the corresponding average value VAV is calculated, with the use of a proportional-integral regulator, the VAV error at full speed is minimized.

According to a possible embodiment as mentioned above, the spinning apparatus 4 comprises two yarn presence sensors 56.

The system in particular uses 2 yarn presence sensors 56 assembled on the accumulation device 32 to provide the information for the control upon exceeding a maximum or a minimum accumulation level. In other words, a first yarn presence sensor 56 detects the achievement of a predetermined maximum yarn accumulation level and a second yarn presence sensor 56 detects the achievement of a predetermined minimum yarn accumulation level.

Figure 10:
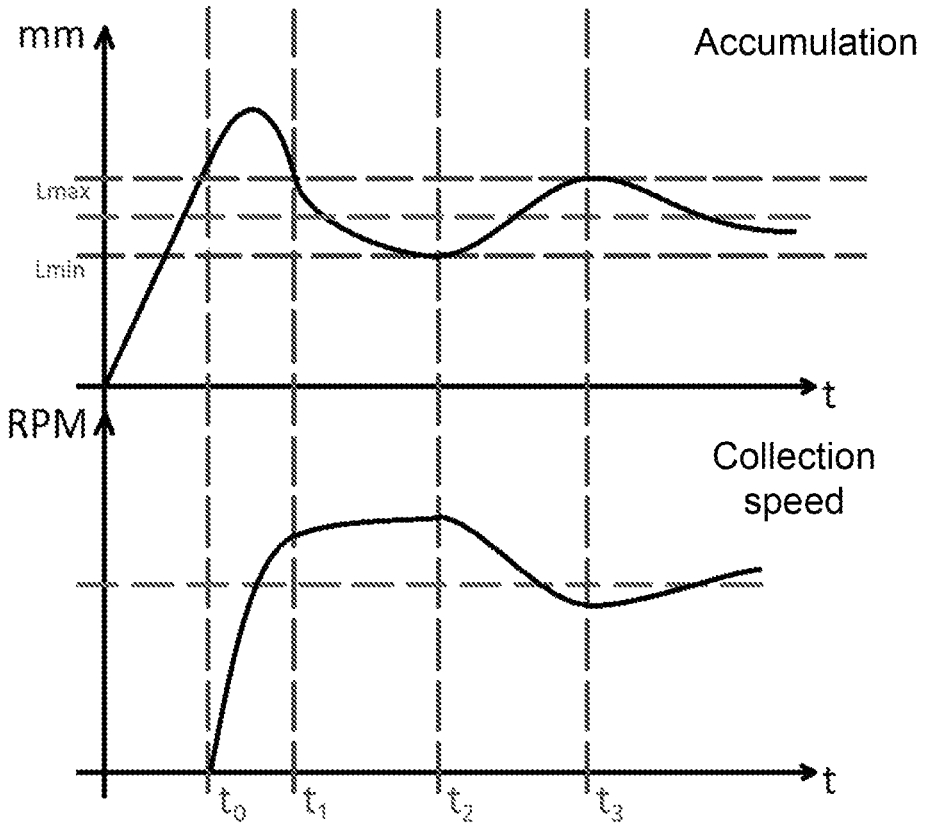

The operation over time of the dual sensor solution is shown in FIG. 10.

After the initial emptying (following the yarn reattachment), the system is to determine the optimal value of the extraction speed of the winding cylinder 24 of reel 16.

Then a first self-adjustment step is performed:

at the instant t0 the joining of the yarn ends is terminated, the yarn produced up to that moment (i.e. during the joining) has been accumulated in the accumulation device 32, both sensors 56 "see" material. Then the emptying of the accumulation device 32 is started by activating the winding or collection cylinder 24 with a speed greater than the nominal speed.

In instant t1, the maximum accumulation level sensor no longer sees material: this implies that the yarn accumulation has been reduced with respect to the maximum value. The processing and control unit saves this collection speed value as VMAX. The speed of the collection or winding cylinder 24 can also be further increased to also empty the minimum accumulation level sensor.

In instant t2, the accumulation device 32 has been emptied to reach the minimum level sensor: this latter sensor detects such a condition and then slows down the extraction to have yarn accumulated again by the accumulation device 32.

In instant t3, the maximum accumulation level sensor is active, the accumulation device 32 has accumulated sufficient yarn, thus saves the current or contingent speed as VMIN, and the processing and control unit 48 calculates the average with the VMAX stored earlier to obtain VAV=(VMAX+VMIN)/2. Such an average speed value (VAV) is then applied to the rotation of the collection or winding cylinder 24.

If the VAV value set for the collection or winding cylinder should lead to activation of one of the two (maximum or minimum) yarn presence sensors 56, the step is implemented of increasing/decreasing VAV by a value inversely proportional to an inactivity time of the sensors 56 themselves.

Such a control allows an accumulation varying within the limits set by the mechanical positioning of the yarn presence sensors 56 to be kept, thus allowing the yarn not to be stressed, and a warping tension to be obtained which is as constant as possible.

As may be appreciated by what is described, the present invention allows the drawbacks introduced in the known art to be overcome.

In particular, the present invention allows the limits to be overcome of the known spinning systems which use attachment/detachment cycles, which do not allow well-made reels to be made because the warp tension suddenly changes in the presence of the cycle, causing layers with different tension to be deposited and thus increasing the possibility of having dropped coils at the edges and therefore the lack of reel homogeneity.

Instead, in addition to using the traditional accumulation system, the present invention provides using a yarn guide per individual head which adapts its operating method according to the spinning pattern, thus maintaining all the advantages of the traditional systems, eliminating the reel formation and stress defects on the yarn.

A further advantage with respect to the traditional solutions is the one of varying, where necessary, the tension of the yarn accumulating, modifying the linear speed of accumulation by a small positive and settable % allowing the system to compact the accumulation of the coils and regularising the unwinding in output. Such a variation is then compensated for by the yarn guide device which will change its course to maintain the best conditions for the formation of the reel.

A further advantage is given by the possibility of uniformly adjusting all the spinning heads, obtaining reels having constant shape, density and content along the whole machine.

A person skilled in the art, with the object of meeting contingent and specific needs, can make several changes and variants to the apparatuses and to the spinning methods described above, moreover all contained within the scope of the invention, which is defined by the following claims.

The invention claimed is:

1. A spinning apparatus with continuous adjustment of a yarn accumulation system comprising at least one spinning head comprising:

a spinning device comprising a spinning chamber for yarn production, a reel on which yarn produced by the spinning device is wound, the reel being rotatably influenced by a yarn guide shaped to impart a rotation movement of the reel for winding the yarn and a traversing movement of the yarn in winding on the reel, an accumulation device of the yarn produced, the accumulation device arranged between the spinning device and the reel and shaped to create a reservoir of yarn not wound on the reel, a joining device configured to join together a first yarn end associated with the spinning device and a second yarn end associated with the reel, and a processing and control unit programmed to control the yarn guide according to a spinning pattern, to adjust accordingly an amount of yarn accumulated in the accumulation device, wherein the processing and control unit is programmed such that:

during a spinning cycle, the reel spins with a yarn extraction speed of the yarn output from the spinning device varying between a minimum and a maximum value, the yarn from the accumulation device is fed to the joining device where the yarn from the accumulation device is joined to the yarn output from the reel, the yarn output from the spinning chamber, during the time of a reattachment cycle, is deposited in the accumulation device, spinning of the spinning device is resumed at an end of yarn joining by the joining device, and the amount of yarn accumulated in the accumulation device is adjusted by adjusting a rotation speed or a collection speed of the reel to:

reduce the amount of yarn accumulated below a threshold value, and make a winding tension as regular as possible, preventing yarn from falling or increasing beyond a certain predetermined percentage value, as a function of an unwinding or filling phase of the accumulation device, and after an initial unwinding of the accumulating device following a yarn re-attachment phase, an optimal value of a reel extraction speed is determined by:

a) reducing the rotation speed of the reel by a value proportional to a duration of the initial unwinding of the accumulation device, b) storing the rotation speed of the reel as a first reel pulling speed V1 when a yarn presence sensor detects the presence of the yarn, c) storing the rotation speed of the reel as a second reel pulling speed V2 when the yarn presence sensor no longer detects the presence of the yarn, and d) calculating an average speed (Vm)=(V1+V2)/2 between the first reel pulling speed V1 when the sensor detects the presence of the yarn and the second reel pulling speed V2 when the sensor detects the absence of the yarn.

2. The spinning apparatus according to claim 1, further comprising a plurality of spinning heads, each spinning head including:

a respective yarn guide that influences a corresponding reel, and a respective accumulation device of the yarn produced, wherein the processing and control unit is programmed to manage each spinning head and the respective yarn guides and accumulation devices independently from each other.

3. The spinning apparatus according to claim 1, wherein the processing and control unit is programmed to continuously adjust a rotation speed of the reel to make substantially constant the amount of yarn accumulated in the accumulation device.

4. The spinning apparatus according to claim 1, wherein the reel spins with the yarn extraction speed varying between the minimum value of 200 [m/min] and the maximum value of 500 [m/min].

5. The spinning apparatus according to claim 1, wherein the processing and control unit is further programmed so that:

the rotation speed of the reel is reduced at regular intervals to further promote yarn accumulation in the accumulation device.

6. The spinning apparatus according to claim 1, wherein the processing and control unit is further programmed so that:

the rotation speed of the reel is increased at regular intervals to facilitate unwinding of the yarn by the accumulation device.

7. The spinning apparatus according to claim 1, wherein the spinning apparatus is an air spinning apparatus.

8. A drawing method for air spinning machines with multiple feeds, the method comprising the steps of:

preparing the spinning apparatus according to claim 1, controlling the yarn guide device and the yarn accumulation device according to the spinning pattern.

9. A spinning apparatus with continuous adjustment of a yarn accumulation system comprising at least one spinning head comprising:

a spinning device comprising a spinning chamber for yarn production, a reel on which yarn produced by the spinning device is wound, the reel being rotatably influenced by a yarn guide shaped to impart a rotation movement of the reel for winding the yarn and a traversing movement of the yarn in winding on the reel, an accumulation device of the yarn produced, the accumulation device arranged between the spinning device and the reel and shaped to create a reservoir of yarn not wound on the reel, a joining device configured to join together a first yarn end associated with the spinning device and a second yarn end associated with the reel, and a processing and control unit programmed to control the yarn guide according to a spinning pattern, to adjust accordingly an amount of yarn accumulated in the accumulation device, wherein the processing and control unit is programmed such that:

during a spinning cycle, the reel spins with a yarn extraction speed of the yarn output from the spinning device varying between a minimum and a maximum value, the yarn from the accumulation device is fed to the joining device where the yarn from the accumulation device is joined to the yarn output from the reel, the yarn output from the spinning chamber, during the time of a reattachment cycle, is deposited in the accumulation device, spinning of the spinning device is resumed at an end of yarn joining by the joining device, and the amount of yarn accumulated in the accumulation device is adjusted by adjusting a rotation speed or a collection speed of the reel to:

reduce the amount of yarn accumulated below a threshold value, and make a winding tension as regular as possible, preventing yarn from falling or increasing beyond a certain predetermined percentage value, as a function of an unwinding or filling phase of the accumulation device, and after an initial unwinding of the accumulating device following a yarn re-attachment phase, an optimal value of a reel extraction speed is determined by:

a) reducing the rotation speed of the reel by a value proportional to a duration of the initial unwinding of the accumulation device, b) storing the rotation speed of the reel as a first reel pulling speed V1 when a yarn presence sensor detects the presence of the yarn, c) storing the rotation speed of the reel as a second reel pulling speed V2 when the yarn presence sensor no longer detects the presence of the yarn, and d) at each change of a status of the yarn presence sensor, updating the stored first or second reel pulling speed, respectively, in the presence or absence of yarn.

10. The spinning apparatus according to claim 9, further comprising a plurality of spinning heads, each spinning head including:

a respective yarn guide that influences a corresponding reel, and a respective accumulation device of the yarn produced, wherein the processing and control unit is programmed to manage each spinning head and the respective yarn guides and accumulation devices independently from each other.

11. The spinning apparatus according to claim 9, wherein the processing and control unit is programmed to continuously adjust a rotation speed of the reel to make substantially constant the amount of yarn accumulated in the accumulation device.

12. The spinning apparatus according to claim 9, wherein the processing and control unit is programmed so that:

the rotation speed of the reel is reduced at regular intervals to further promote yarn accumulation in the accumulation device.

13. A spinning apparatus with continuous adjustment of a yarn accumulation system comprising at least one spinning head comprising:

a spinning device comprising a spinning chamber for yarn production, a reel on which yarn produced by the spinning device is wound, the reel being rotatably influenced by a yarn guide shaped to impart a rotation movement of the reel for winding the yarn and a traversing movement of the yarn in winding on the reel, an accumulation device of the yarn produced, the accumulation device arranged between the spinning device and the reel and shaped to create a reservoir of yarn not wound on the reel, a joining device configured to join together a first yarn end associated with the spinning device and a second yarn end associated with the reel, and a processing and control unit programmed to control the yarn guide according to a spinning pattern, to adjust accordingly an amount of yarn accumulated in the accumulation device, wherein the processing and control unit is programmed to:

vary tension of the yarn accumulating in the accumulation device by modifying a linear speed of accumulation by a positive and settable percentage to allow the accumulation of coils of the yarn to be compacted and to allow unwinding of the yarn with consistent output, compensate for the varying tension by changing a course of the yarn guide to maintain a selected extraction speed for formation of the reel;

terminate a yarn joining operation at an instant t=t0 and begin to unwind the yarn in the accumulation device;

activate a yarn presence sensor;

increase a rotation or collection speed of the reel to rapidly unwind yarn from the accumulation device;

deactivate the yarn presence sensor at an instant t=t1 when the accumulation device has been unwound beyond a target reserve level;

store the collection or rotation speed of the reel VMAX=V1, and reduce the collection speed to increase the target reserve level of yarn accumulation;

activate the yarn presence sensor at an instant t=t2 when the accumulation device exceeds the target reserve level; and store the collection speed VMIN=V2, and adjust the collection speed to an average VAV value between VMIN and VMAX.

14. The spinning apparatus according to claim 13, wherein the processing and control unit is programmed to carry out the following steps:

at each transition of the yarn presence sensor, the VMIN or VMAX value is updated, and the corresponding average value VAV is calculated, and with a use of a proportional-integral regulator, VAV error at full speed is minimized.

15. The spinning apparatus according to claim 13, further comprising a plurality of spinning heads, each spinning head including:

a respective yarn guide that influences a corresponding reel, and a respective accumulation device of the yarn produced, wherein the processing and control unit is programmed to manage each spinning head and the respective yarn guides and accumulation devices independently from each other.

16. The spinning apparatus according to claim 13, wherein the processing and control unit is programmed to continuously adjust a rotation speed of the reel to make substantially constant the amount of yarn accumulated in the accumulation device.

17. The spinning apparatus according to claim 13, wherein the processing and control unit is programmed so that:

the rotation speed of the reel is increased at regular intervals to facilitate unwinding of the yarn by the accumulation device.

18. A spinning apparatus with continuous adjustment of a yarn accumulation system comprising at least one spinning head comprising:

a spinning device comprising a spinning chamber for yarn production, a reel on which yarn produced by the spinning device is wound, the reel being rotatably influenced by a yarn guide shaped to impart a rotation movement of the reel for winding the yarn and a traversing movement of the yarn in winding on the reel, an accumulation device of the yarn produced, the accumulation device arranged between the spinning device and the reel and shaped to create a reservoir of yarn not wound on the reel, a joining device configured to join together a first yarn end associated with the spinning device and a second yarn end associated with the reel, at least two yarn presence sensors located at a first distance from each other, and a processing and control unit programmed to control the yarn guide according to a spinning pattern, to adjust accordingly an amount of yarn accumulated in the accumulation device, wherein the processing and control unit is programmed to perform a first self-adjusting step after an initial unwinding of the accumulation device following a yarn re-attachment phase, wherein the first self-adjusting step includes varying a rotation speed and accumulation of the reel to keep the amount of yarn accumulated on the reel within predefined limits of the at least two yarn presence sensors by:

terminating joining of the first and second yarn ends at an instant t=t0 when the yarn produced until the instant t=t0 has been accumulated in the accumulation device, and when the at least two yarn presence sensors both detect the presence of material;

starting the initial unwinding of the accumulation device by activating a winding or collection cylinder with a speed greater than a nominal speed;

storing the corresponding collection speed value VMAX of the collection or winding cylinder at an instant t=t1 when a first yarn presence sensor of the at least two yarn presence sensors no longer detects material;

unwinding the accumulation device to reach the minimum yarn presence level detected by a second yarn presence sensor of the at least two yarn presence sensors at an instant t=t2;

storing the current speed VMIN at an instant t=t3 when the accumulation device has accumulated sufficient yarn to be detected by the first yarn presence sensor;

calculating an average speed VAV=(VMAX+VMIN)/2; and applying the average speed value (VAV) to rotation of the collection or winding cylinder.

19. The spinning apparatus according to claim 18, wherein the at least two yarn presence sensors are respectively mounted on the accumulation device to provide information to the processing and control unit upon exceeding a maximum or a minimum accumulation level, so that the first yarn presence sensor detects achievement of a predetermined maximum yarn accumulation level and the second yarn presence sensor detects achievement of a predetermined minimum yarn accumulation level, the processing and control unit programmed to maintain a variable accumulation within the minimum and maximum yarn accumulation levels.

20. The spinning apparatus according to claim 18, wherein the processing and control unit is programmed so that if the VAV value set for the collection or winding cylinder leads to activation of one of the at least two yarn presence sensors, the processing and control unit increases the VAV value by a value inversely proportional to an inactivity time of the two yarn presence sensors.

* * * * *